US006283844B1

(12) United States Patent
Tank

(10) Patent No.: US 6,283,844 B1
(45) Date of Patent: Sep. 4, 2001

(54) TOOL COMPONENT

(76) Inventor: Klaus Tank, 9 Warbleton Avenue, Essexwold, Johannesburg (ZA)

( * ) Notice: Subject to any disclaimer, the term of this patent is extended or adjusted under 35 U.S.C. 154(b) by 607 days.

(21) Appl. No.: 08/672,440

(22) Filed: Jun. 28, 1996

(30) Foreign Application Priority Data

Jul. 3, 1995 (ZA) ..... 95/5502

(51) Int. Cl.[7] ..... B23F 21/03; B23F 21/23
(52) U.S. Cl. ..... 451/540; 407/118
(58) Field of Search ..... 407/118, 119; 408/145; 175/422, 426, 434, 432; 451/540

(56) References Cited

U.S. PATENT DOCUMENTS

| | | | | |
|---|---|---|---|---|
| 4,268,276 | * | 5/1981 | Bovenkerk | 175/434 |
| 4,784,023 | | 11/1988 | Dennis . | |
| 4,787,466 | * | 11/1988 | Tomlinson et al. | 175/432 |
| 4,997,049 | | 3/1991 | Tank et al. . | |
| 5,060,739 | * | 10/1991 | Griffin | 175/432 |
| 5,351,773 | | 10/1994 | Yanagisawa . | |
| 5,431,239 | * | 7/1995 | Tibbitts et al. | 175/432 |
| 5,472,376 | * | 12/1995 | Olmstead et al. | 175/432 |
| 5,484,330 | * | 1/1996 | Flood et al. | 175/432 |

FOREIGN PATENT DOCUMENTS

| | | |
|---|---|---|
| 0 604 211 A1 | 6/1994 | (EP) . |
| 0 659 510 A1 | 6/1995 | (EP) . |

* cited by examiner

*Primary Examiner*—Derris H. Banks
(74) *Attorney, Agent, or Firm*—Scully, Scott, Murphy & Presser

(57) ABSTRACT

A tool component is provided which has particular application in mining picks and drag bits. The component comprises an abrasive compact having a flat working surface presenting a cutting edge around its periphery, and an opposite surface bonded to a cemented carbide substrate along an interface. A recess is provided which extends into the abrasive compact from the interface and is filled with abrasive compact. The recess has a central portion and an outer portion which completely surrounds, and is shallower than the central portion. The central portion defines, in plan, at least one substantially wedge-shaped configuration, the configuration having a narrow end coincident with a side surface of the component and the sides extending into the component and diverging from the narrow end.

12 Claims, 2 Drawing Sheets

TOOL COMPONENT

BACKGROUND OF THE INVENTION

This invention relates to tool components.

A composite abrasive compact consists of an abrasive compact bonded to a cemented carbide substrate. The abrasive compact will generally be a diamond or cubic boron nitride compact. Such composite abrasive compacts are used extensively in industry and are described and illustrated in the patent literature.

There is described in the patent literature a tool component comprising an abrasive compact bonded to a cemented carbide substrate along an interface which has a stepped configuration. Examples of such literature are U.S. Pat. Nos. 4,784,023, 4,997,049 and 5,351,773.

SUMMARY OF THE INVENTION

According to the present invention, there is provided a tool component comprising an abrasive compact having a flat working surface presenting a cutting edge and an opposite surface bonded to a cemented carbide substrate along an interface, a recess extending into the cemented carbide substrate from the interface filled with abrasive compact and having a central portion and an outer portion, shallower than the central portion, which defines, in plan, at least one substantially wedge-shaped configuration, the configuration having a narrow end coincident with a side surface of the component, and sides extending into the component and diverging from the narrow end.

In one preferred form of the invention, the outer portion defines, in plan, three substantially wedge-shaped configurations. An example of a shape which will produce such configurations is one in which the outer portion has a substantially triangular shape in plan.

Further according to the invention, a mining pick comprises an elongate body, one end of which is adapted for location in a supporting structure such as a drum, and an opposite working end, the working end having a tool component as described above mounted therein such that a cutting edge is presented to a substrate to be cut, the cutting edge being coincident with the narrow end of a wedge-shaped configuration of the tool component.

DESCRIPTION OF EMBODIMENTS

The narrow end of the configuration in the tool component of the invention may be defined by a portion of the cutting edge, i.e. have a curved profile, or by a point in the cutting edge. Generally, and in the case of a mining pick as described above, the cutting edge of the tool component which will be used to cut a substrate will be coincident with the narrow end of the configuration. Thus, in practice the thinner compact layer to either side of the narrow end will wear away quicker creating a sharper, more effective, cutting action.

The central portion will generally be completely surrounded by the outer portion. The shape of the central portion can vary but will typically be circular or substantially triangular in plan. The central portion is deeper than the outer portion. This arrangement of a deeper portion surrounded by a shallower portion has been found to reduce the incidence of cracking or spalling occurring in the working surface of the abrasive compact during use of the tool component in a cutting action.

The tool component of the invention will typically be a right circular cylindrical shape. Other shapes are possible, but for many applications, particularly as cutting inserts for drag bits or mining picks, a right circular cylindrical shape is the preferred one.

The abrasive compact may be any known in the art, but will typically be a diamond compact, also known as PCD, or a cubic boron nitride compact also known as PCBN. The abrasive compact may be unimodal, i.e. the particles used in the manufacture being all of essentially the same average size, or multimodal, i.e. the particles used in the manufacture having a range of average sizes.

The cemented carbide for the substrate will be any known in the art such as cemented tungsten carbide, cemented titanium carbide, cemented tantalum carbide, cemented molybdenum carbide or mixtures thereof.

Figure 2:
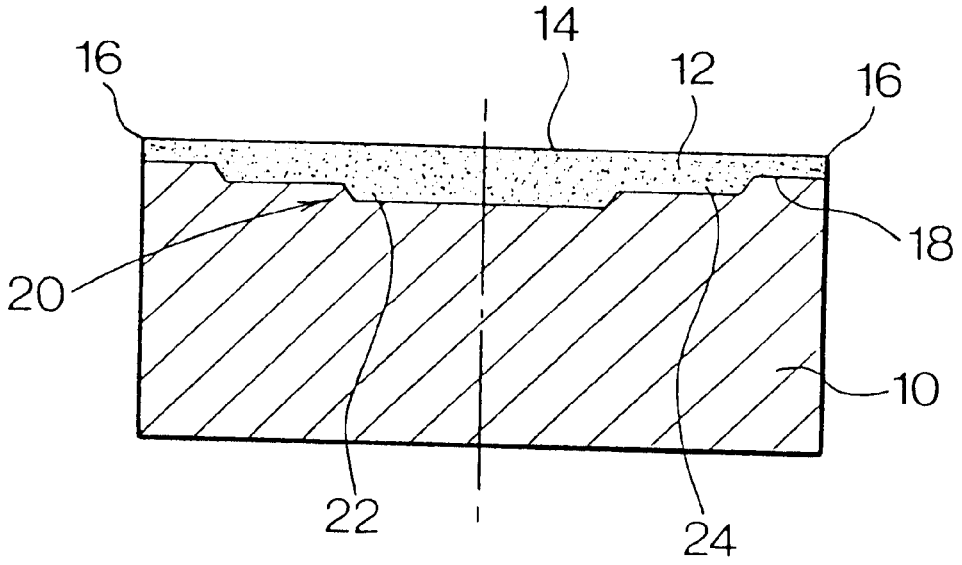
FIG. 2 illustrates a sectional side view along line 2—2 of FIG. 1.
Figure 1:
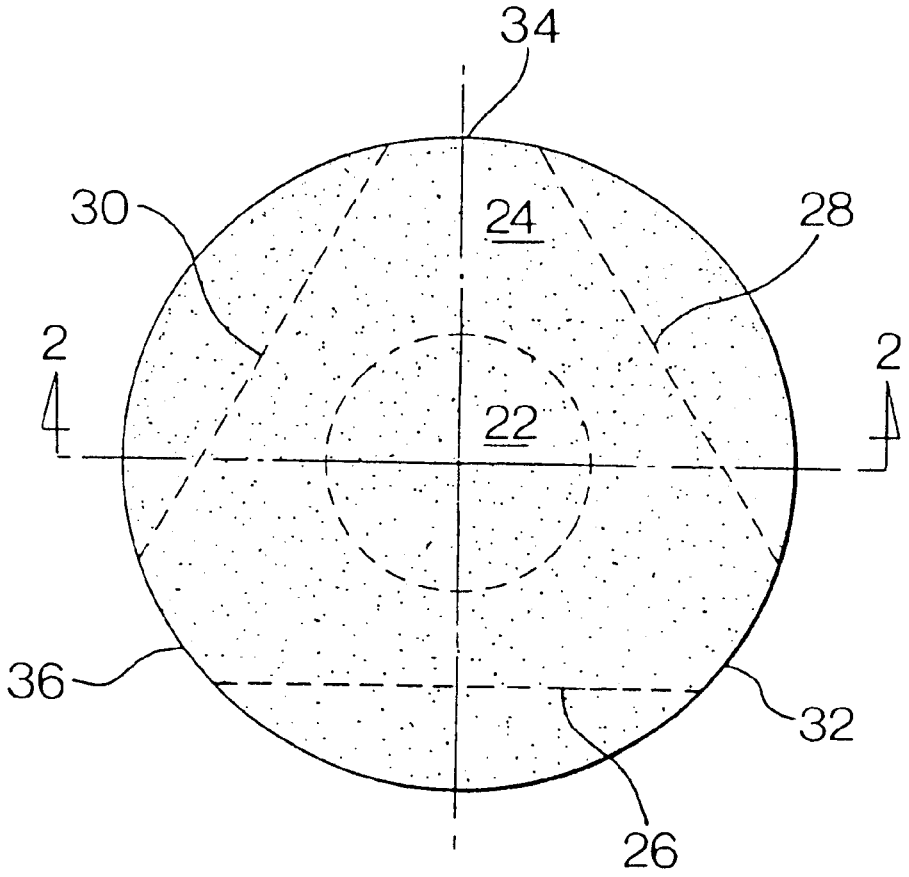
FIG. 1 illustrates a plan view of a first embodiment of the invention.

Embodiments of the invention will now be described with reference to the accompanying drawings. FIGS. 1 and 2 illustrate a first embodiment. Referring to these Figures, a tool component comprises a cemented carbide substrate 10 having a layer 12 of abrasive compact bonded thereto. The abrasive compact layer 12 comprises an upper flat working surface 14 defining a cutting edge 16 around its periphery and having an opposite surface bonded to a surface of the cemented carbide substrate along interface 18.

Extending into the substrate 10 is a recess 20 which is filled with the abrasive compact. The abrasive compact filling the recess 20 is the same as that of the layer 12 and is integral therewith. The recess 20 has a circular central portion 22 and a shallower outer portion 24 which surrounds the central portion 22 completely. The outer portion 24 is substantially triangular in shape having sides 26, 28 and 30. Defined between the sides 26, 28 and 30 are regions 32, 34 and 36 of the cutting edge 16. Thus, the triangle defines three substantially wedge-shaped configurations having narrow ends 32, 34 and 36 and diverging sides 26, 28 and 28, 30 and 30, 26, respectively.

Figure 3:
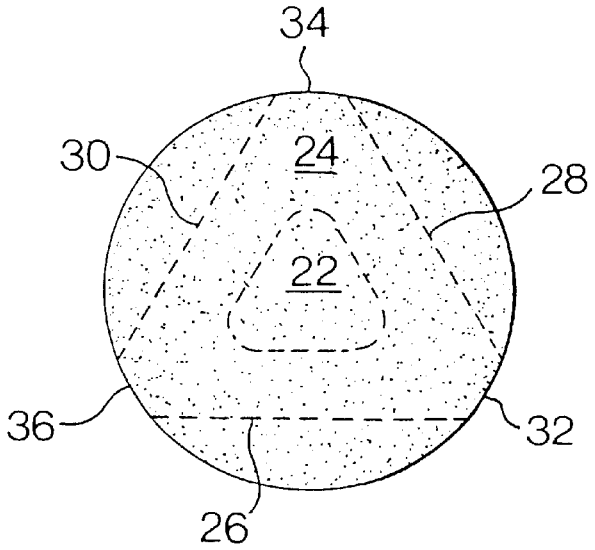
FIG. 3 is a plan view of a second embodiment of the invention.

FIG. 3 illustrates a plan view of a second embodiment of a tool component. In this Figure, like parts to those of the first embodiment illustrated by FIGS. 1 and 2 carry like numerals. It will be noted that the difference with this embodiment is that the central portion 22 is substantially triangular in shape.

The tool components illustrated above have particular application in mining picks and drag bits. The use of a tool component, as illustrated by FIGS. 1 and 2, in a mining pick will now be described with reference to FIGS. 4 and 5.

Figure 4:
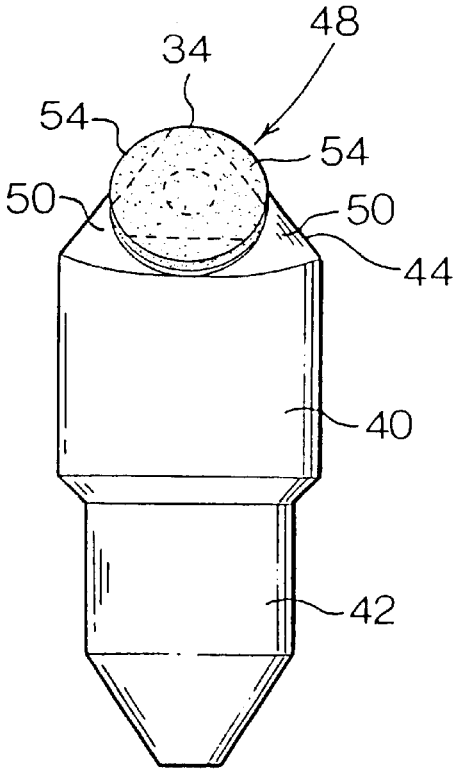
FIG. 4 is a front view of a tool component as illustrated by FIG. 1 mounted in a mining pick.
Figure 5:
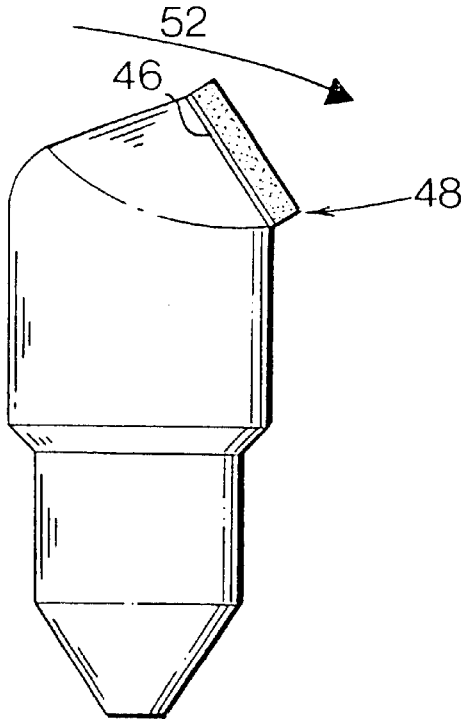
FIG. 5 is a side view of the mining pick of FIG. 4.

Referring to FIGS. 4 and 5, a mining pick comprises an elongate body 40 having an end 42 shaped and adapted to be received in a supporting structure such as a drum (not shown) and a working end 44. The working end 44 has a sloping flat surface 46 on which is mounted a tool component 48. The working end 44 is cut away to either side 50 of the tool component, in known and standard manner.

The manner in which the tool component is mounted on the surface 46 is important. The direction rotation of the mining pick, in use, is in the direction of arrow 52, as can be seen in FIG. 5. The mounting of the tool component on the surface 46 is such that one of the cutting regions, 32, 34 or 36 of the cutting edge 16 is at the top and is the edge which is presented to a substrate being cut or abraded. The thinner compact layer to either side of the wedge-shaped section presented for cutting will wear away quicker than the wedge itself creating a sharper and more effective cutting action. Thus, for example, referring to FIG. 4, the cutting edge in the region 34 will wear away slower than the compact regions 54 to either side thereof, creating a more effective cutting action.

As the wear continues, more and more abrasive compact will be removed eventually exposing the central portion 22. This region will have a higher wear resistance than the surrounding region because of the increase in the diamond layer thickness.

It has also been found that the step configuration of the recess reduces the incidence of cracking or spalling occurring in the working surface of the abrasive compact layer.

The tool component of the invention may be made by methods known in the art. For example, a cemented carbide body will halve a recess having the desired stepped configuration formed therein. The abrasive particles necessary for forming the abrasive compact are then placed in the recess. This forms an unbonded assembly which can be subjected to conditions of elevated temperature and pressure suitable to produce the abrasive compact. These conditions are well known and described, for example, in the United States patent specifications discussed above.

I claim:

1. A tool component comprising an abrasive compact having a flat working surface presenting a cutting edge around its periphery and an opposite surface bonded to a cemented carbide substrate along an interface, a recess extending into the cemented carbide substrate from the interface filled with abrasive compact and having a central portion and an outer portion, shallower than the central portion, which defines, in plan, at least one substantially wedge-shaped configuration, the configuration having a narrow end coincident with a side surface of the component and sides extending into the component and diverging from the narrow end.

2. A tool component according to claim 1 wherein the outer portion defines, in plan, three substantially wedge-shaped configurations.

3. A tool component according to claim 1 wherein the outer portion has a substantially triangular shape in plan.

4. A tool component according to claim 1 wherein the narrow end is defined by a portion of the cutting edge.

5. A tool component according to claim 1 wherein the narrow end is defined by a point in the cutting edge.

6. A tool component according to claim 1 which is right circular cylindrical in shape.

7. A tool component according to claim 1 wherein the central portion is circular in plan.

8. A tool component according to claim 1 wherein the central portion is substantially triangular in plan.

9. A tool component according to claim 1 wherein the outer portion surrounds the central portion completely.

10. A tool component according to claim 1 wherein the abrasive compact is a diamond or cubic boron nitride compact.

11. A tool component according to claim 1 wherein the cemented carbide for the substrate is selected from cemented tungsten carbide, cemented titanium carbide, cemented tantalum carbide, cemented molybdenum carbide and mixtures thereof.

12. A mining pick comprising an elongate body, one end of which is adapted for location in a supporting structure, and an opposite working end, the working end having a tool component according to claim 1 mounted therein such that a cutting edge is presented to a substrate to be cut, the cutting edge being coincident with the narrow end of a wedge-shaped configuration of the tool component.

* * * * *